United States Patent [19]

Verini

[11] 4,114,158

[45] Sep. 12, 1978

[54] MOUNT ASSEMBLY FOR ANTENNAS WITH MALE-FEMALE SECURING MEANS

[76] Inventor: Anthony J. Verini, 30 Lenox Ave., Green Brook, N.J. 08812

[21] Appl. No.: 805,889

[22] Filed: Jun. 13, 1977

[51] Int. Cl.[2] ..... H01Q 1/32

[52] U.S. Cl. ..... 343/715; 248/223.4; 248/223.1

[58] Field of Search ..... 343/711–715; 248/223.4, 221.3, 222.4, 223.1, 223.3, 534, 539

[56] References Cited

U.S. PATENT DOCUMENTS 4,028,705 6/1977 Loyd ..... 343/715

FOREIGN PATENT DOCUMENTS 2,455,867 11/1974 Fed. Rep. of Germany ..... 248/221.3

*Primary Examiner*—Alfred E. Smith
*Assistant Examiner*—David K. Moore
*Attorney, Agent, or Firm*—Frederick W. Padden

[57] ABSTRACT

A mount assembly for objects such as CB antennas is described in which: a stepped bracket has an upper tread for carrying the object, a lower tread having a recess therein and a riser connecting the treads together; a support member including a pair of guides mounted on the body and defining a channel, and a first U-shaped member connected obliquely to the guides so as to define an entrance port through which said lower tread is insertable into said channel; a cover plate partially enclosing the channel and having thereon a male member which snaps into the recess when the lower tread is fully inserted into the channel; and a second U-shaped member connected transversely to the first U-shaped member so as to define a slot which engages an edge of the body. Also described is an embodiment in which the recess is in the cover plate and the male member is on the lower tread as well as several configurations of the support member, second U-shaped member and lower treads. One such configuration eliminates the first U-shaped member, includes means for vertically aligning the antenna and is universal in the sense that the support member can be mounted on essentially all known trunk lids regardless of differences from one make vehicle to another.

21 Claims, 5 Drawing Figures

MOUNT ASSEMBLY FOR ANTENNAS WITH MALE-FEMALE SECURING MEANS

BACKGROUND OF THE INVENTION

This invention relates to mount assemblies and, more particularly to assemblies for mounting CB antennas and the like on, for example, the trunk lid of an automobile.

It would probably be a gross understatement to say that citizens' band (CB) radio equipment has, in the vernacular, caught on like wild fire. But, the facts are inescapable: millions of Americans have installed CB transceivers in their motor vehicles and have spent many millions of dollars doing so. While this proliferation of CB equipment has contributed substantially to convenient and widespread communication for business, recreational and public interest purposes, owners of CB equipment have suffered economic loss in the damage to transceivers, antennas and mounting brackets as well as the vehicle itslef due to theft and vandalism. Because the public display of a CB antenna on a vehicle roof or trunk lid, for example, is known to attract thieves and vandals, there is a need for antenna mounts which, on the one hand, safeguard against desired detachment from vehicles and which, on the other hand, permit ready detachment for storage of the antenna out of view, particularly when the vehicle is to be left unattended.

SUMMARY OF THE INVENTION

It is, therefore, a broad object of my invention to provide an assembly for detachably mounting an object on a rigid body.

It is a more specific object of my invention to provide an assembly for detachably mounting a CB antenna to, for example, the trunk lid or hatch-back rear door of an automobile.

It is another object of my invention to provide such an assembly which safeguards against undesired or unauthorized detachment of the antenna and yet permits ready detachment for storage purposes.

It is one more object of my invention to provide such as assembly which is universal in the sense that it can be mounted on all trunk lids regadless of differences from one make vehicle to another.

It is yet another object of my invention to provide such an assembly which permits the antenna to be vertically aligned regardless of trunk contour.

Accordingly, my invention in general terms is an assembly for mounting an object, such as a CB antenna, on a rigid body, such as an automobile trunk lid, comprising: a bracket for carrying the object, a support member mounted on the body and having a channel therein for receiving a portion of the bracket, and securing means for releaseably locking the bracket portion to the support member including male and female members located on separate ones of the bracket portion and support member and adpated to engage one another when the bracket portion is inserted into the channel.

In a specific exemplary embodiment of my invention, an assembly is adapted for mounting a CB antenna to, for example, a trunk lid. A stepped bracket includes an upper tread on which the antenna is mounted, a lower tread having a recess therein and a groove extending from the recess to a free edge of the lower tread, and a riser connecting the treads together. A pair of parallel guides are mounted on the underside of the trunk lid and define a channel into which the lower tread is insertable, and a first U-shaped member has its legs connected obliquely to the guides so as to define an entrance port in communication with the channel. A cover plate, which is attached to the guides so as to partially enclose the channel, has a male member which protrudes into the channel and is guided by the groove into the recess when the lower tread is inserted through the entrance port into the channel. A second U-shaped member is transversely connected to the first U-shaped member and has a slot which engages the lip of the trunk lid. Fasteners extend through the second U-shaped member to secure the trunk lip in the slot.

In operation, with the trunk lid open the lower tread is inserted through the entrance port into the channel. When fully inserted, the male member snaps into the recess and the riser abuts flush with the first or second U-shaped member (depending on which of two alternative configurations of the support member is employed, as discussed hereinafter). Then, the trunk lid is closed so that the lower tread is under the lid and the riser protrudes through the space between the lid and fender. In this portion, the mount and antenna are safeguarded from theft and are ready for normal operation of the CB transceiver. To store the antenna, the procedure is reversed: the trunk lid is opened, and the stepped bracket is pulled outwardly to release the male member from the recess. The bracket, with antenna attached, can now be stored in the trunk.

Alternatively, the recess may be located on the cover plate and the male member on the lower tread.

Accordingly to another aspect of my invention the foregoing mount assembly is modified to render it universal and to permit vertical alignment of the antenna regardless of trunk contour. In the first instance, the first U-shaped member is eliminated and the channeled support member is made relatively long and slender so that it can be affixed under the lip of a trunk lid. Since all known trunk lids, regardless of their overall contour, have such a lip, the support member and hence the mount assembly are in a sense universal. Secondly, the second U-shaped member, which is a centrally located appendage above the channel entrance, includes on a leg thereof a reversible Teflon sleeve which has walls of different thickness above and below the leg. By choosing the appropriate thickness a snug fit of the trunk lip in the slot of the U can be assured. This reature allows my mount to be utilized with various trunk lids regardless of lip thickness and thus provides one more aspect of its universality. Thirdly, a plurality of set screws extend through the support member to enable adjustment of its orientation with respect to the trunk lid. This feature enables the antenna to be vertically aligned regardless of variations in the trunk lip contour.

BRIEF DESCRIPTION OF THE DRAWING

These and other objects of my invention, together with its various features and advantages, can be readily understood from the following more detailed description taken in conjunction with the accompanying drawing, in which.

and

Figure 4:
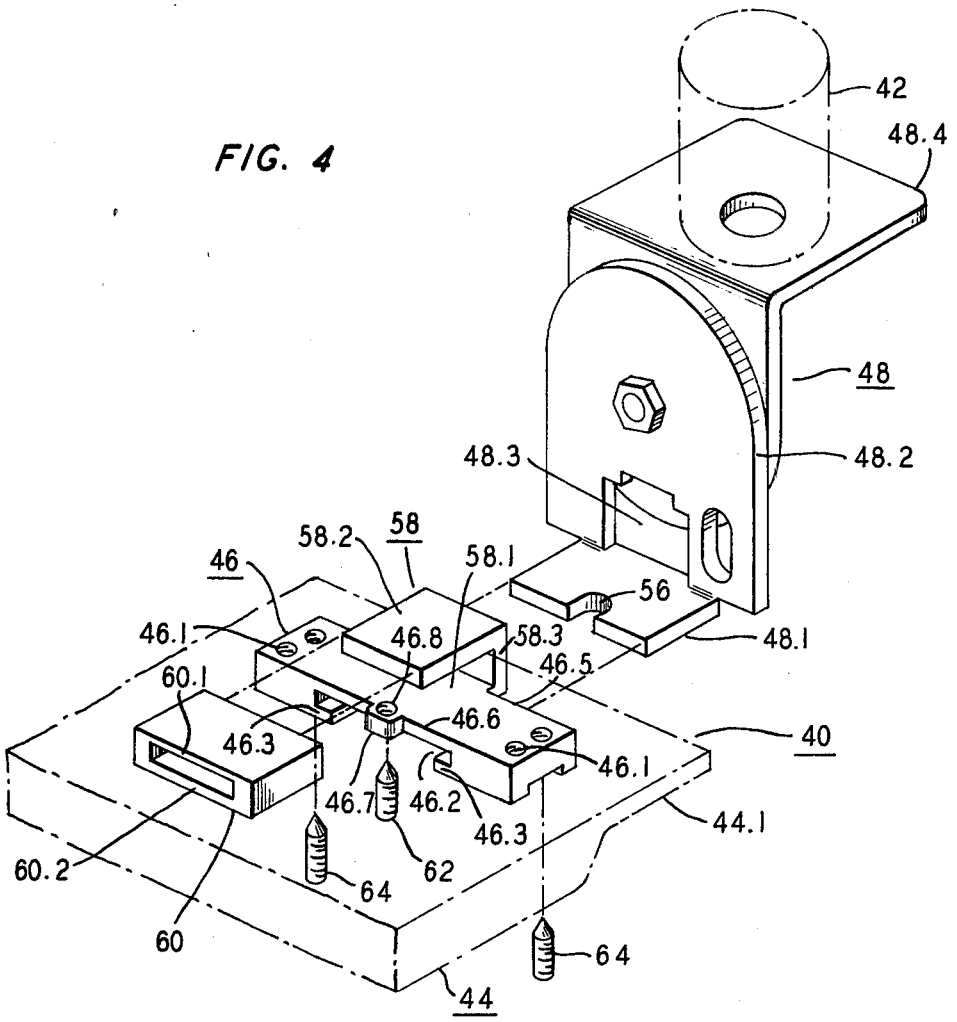
FIG. 4 is an exploded view of a universal mount assembly in accordance with another embodiment of my invention.
Figure 5:
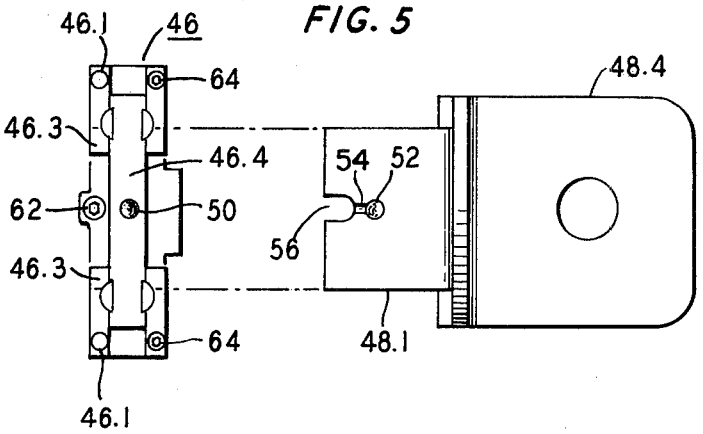

FIG. 5 is a bottom view of FIG. 4.

DETAILED DESCRIPTION

Figure 1:
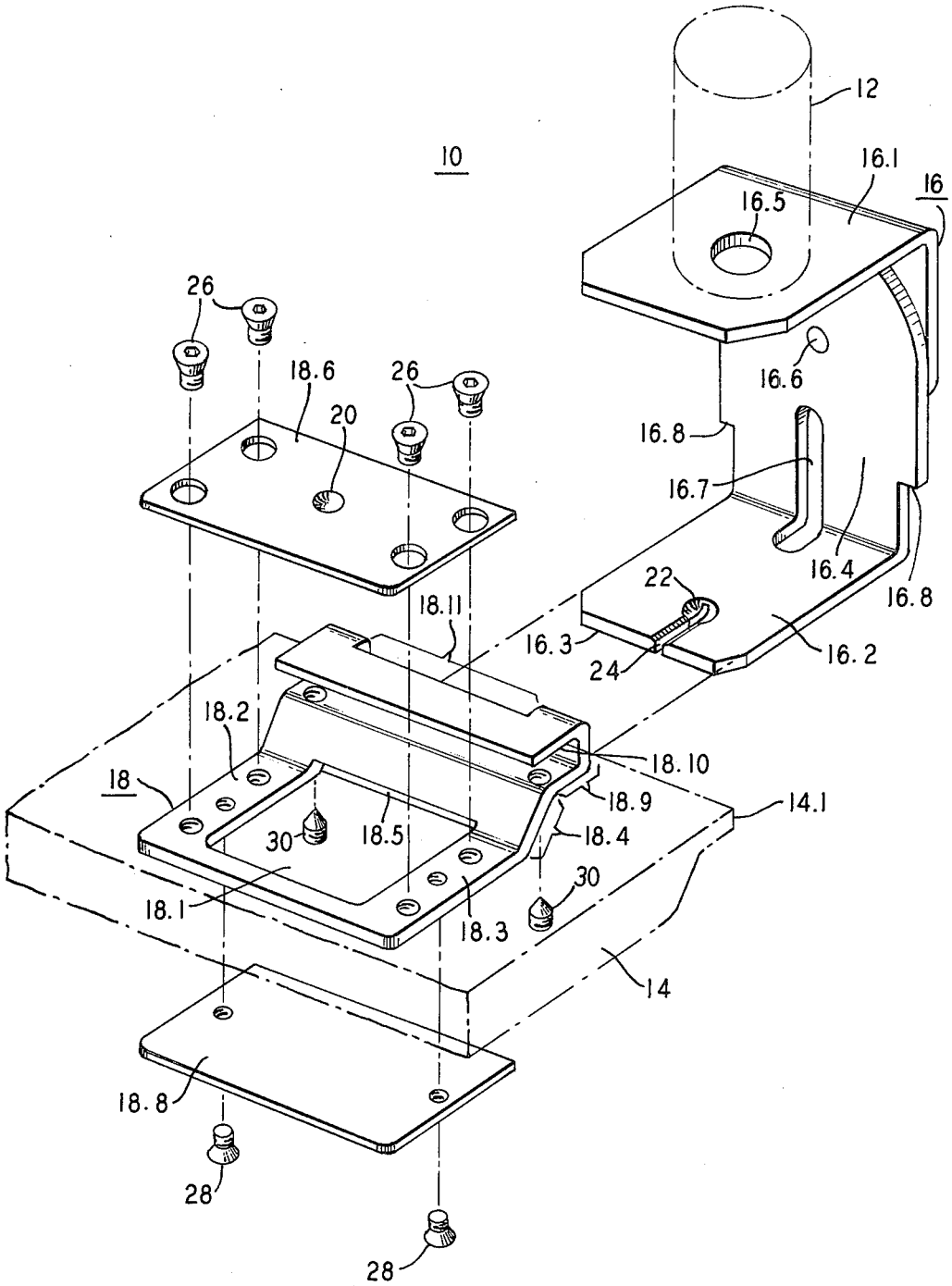
FIG. 1 is an exploded view of a mount assembly in accordance with one embodiment of my invention in which the recess is located in the lower tread and the male member is on the cover plate.

With reference now to FIG. 1, there is shown an assembly 10 for mounting an object 12 such as a CB antenna on a rigid body 14 such as a trunk lid or the like. Assembly 10 comprises a bracket 16 for carrying object 12 and a support member 18 mounted on body 14 and having a channel 18.1 therein for receiving a portion 16.2 of the bracket 16. Securing means for releasably locking the bracket portion 16.2 to support member 18 comprises male and female members 20 and 22 located on separate ones of the bracket portion 16.2 and support member 18 and adpated to engage one another when bracket portion 16.2 is inserted into channel 18.1.

Figure 2:
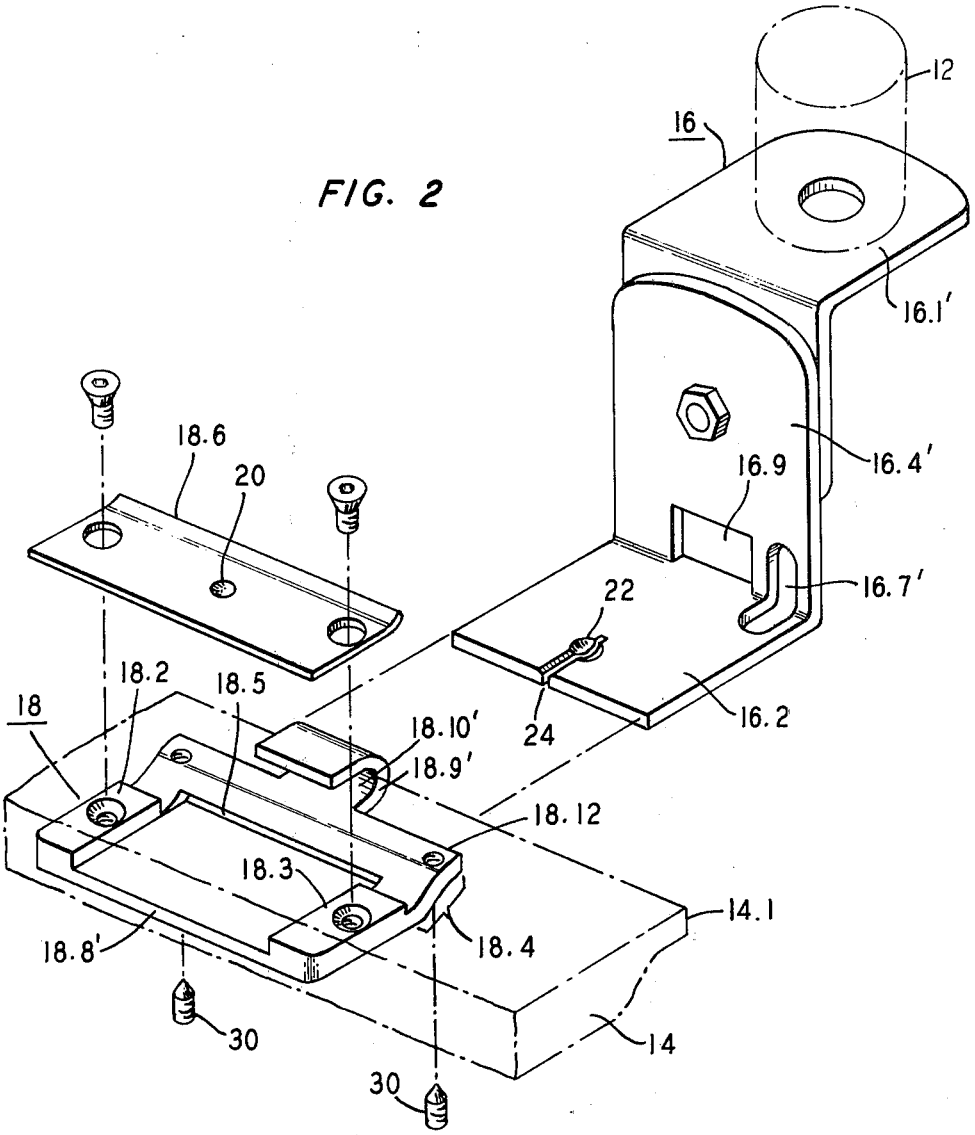
FIG. 2 is analogous to FIG. 1 except that only a single cover plate is used, as well as a modified bracket-support member configuration.

In the illustrative embodiment depicted in FIG. 1, bracket 16 has a stepped configuration including an upper tread 16.1 for carrying antenna 12 in hole 16.5, a lower read (bracket portion) 16.2 having a recess 22 therein and a groove 24 extending from recess 22 to free edge 16.3, and a riser 16.4 connecting treads 16.1 and 16.2. Optionally, groove 24 is beveled along its top and extends completely through the thickness of lower tread 16.2. As shown, both treads extend from riser 16.4 in the same direction but can be oppositely directed as illustrated in FIG. 2. In addition, although riser 16.4 is depicted as two risers joined by a fastener 16.6, bracket 16 could readily be formed from a single piece of material, typically steel, so that riser 16.4 would also be a single piece. Elongated aperture 16.7 extends through lower tread 16.2 and riser 16.4, as well as the joint therebetween, to permit a cable (not shown) from antenna 12 to be snaked therethrough.

Continuing with reference to FIG. 1, support member 18 includes a pair of parallel guides 18.2–18.3 defining channel 18.1 therebetween into which lower tread 16.2 is insertable. To this end, the width of channel 18.1 is substantially equal to that of lower tread 16.2. A first U-shaped member 18.4 has its legs connected obliquely to guides 18.2–18.3 so as to define an entrance port 18.5 in communication with channel 18.1. Channel 18.1 is partially enclosed (that is, port 18.5 is left open) by a pair of cover plates 18.6 and 18.8 secured to opposite sides of guides 18.2–18.3 by means of fasteners (e.g., screws, rivets) 26 and 28, respectively. Male member 20 is formed in cover plate 18.6 by conical dimple or indentation which protrudes into channel 18.1 and extends transversely to the direction of insertion of lower tread 16.2.

Support member 18 further includes a second U-shaped member 18.9 connected transversely to first U-shaped member 18.4. As shown, member 18.9 has a base and two legs formed by folding a portion of member 18.4 upon itself to define a slot 18.10 between the legs and which engage the lip 14.1 of trunk lid (rigid body) 14. A substantially rectangular window or indentation 18.11 is centrally located in the base of the U of member 18.9 so that riser 16.4 fits flush therein when lower tread 16.2 is fully inserted into channel 18.1. Although lower tread 16.2 is depicted as having a pair of shoulders 16.8 which rest upon U-shaped member 18.9 when the lower tread is inserted as above, bracket 18 could readily be dimensioned to fit into window 18.11 without the need for such shoulders.

Finally, fastener means 30 extend through the lower leg of second U-shaped member 18.9 for securing the trunk lip 14.1 in slot 18.10, and guides 18.2–18.3 along with members 18.4 and 18.9 are configured to be substantially congruent with a cross-section of trunk lid 14 so as to fit flush thereon.

To facilitate discussion of the operation of the foregoing assembly 10, assume that initially support 18 is assembled but is detached from bracket 16 and trunk lid 14. With the trunk open support member 18 is mounted on the trunk lid 14 by engaging lip 14.1 in slot 18.10 with guides 18.2–18.3 on the underside of the lid. Fasteners 30 are then screwed inwardly to secure the support member 18 on lid 14. To this end, fasteners 30 are preferably oriented obliquely so as to urge the trunk lip 14.1 against the base of U-shaped member 18.9.

With the support member 18 secured, bracket 16 is mounted by inserting lower tread 16.2 into channel 18.1 between guides 18.2–18.3 and cover plates 18.6–18.8. As tread 16.2 is inserted, groove 24 guides male member 20 into recess 22 where it snaps into place, releaseably locking bracket 16 to support member 18. Next, the trunk lid is closed and locked so that lower tread 16.2 is located within the trunk space, but riser 16.4 protrudes through the space between trunk lip 14.1 and the vehicle fender (not shown). In this position, the antenna mounted on tread 16.1 is ready for normal CB transceiver operation, and bracket 16 is safeguarded from theft. In order to store the antenna, as when the vehicle is to be left unattended, the procedure is essentially reversed—the trunk lid is unlocked and opened, lower tread 16.2 is withdrawn from channel 18.1 and bracket 16 is laid in the trunk space. Of course, support member 18 need not be detached.

An alternative embodiment of my invention is shown in FIG. 2 in which components corresponding to those of FIG. 1 have been given identical numerals whereas analogous, but modified, components have been given primed numerical designations. Thus, FIG. 2 differs from FIG. 1 in the following respects: (1) upper tread 16.1′ and lower tread 16.2 are directed in opposite directions from riser 16.4′; (2) riser 16.4′ has a rectangular window 16.9 centrally located along the joint with lower tread 16.2 and oblong aperture 16.7′ is positioned to one side of window 16.9; (3) lower cover plate 18.8′ is an integral part of support member 18 and forms a base on which guides 18.2–18.3 are located; and (4) the second U-shaped member 18.9′ is an appendage located centrally on free edge 18.12 of first U-shaped member 18.4.

In operation, with trunk lid 14 open, second U-shaped member 18.9′ is placed around the trunk lip 14.1 and fasteners 30 are screwed inwardly to secure lip 14.1 in slot 18.10′. Then, lower tread 16.2 is inserted through entrance port 18.5 into the channel between guides 18.2–18.3, cover plate 18.6 and base 18.8′. Groove 24 guides male member 20 into recess 22 where it snaps into place, releaseably locking bracket 16 to support member 18. When lower tread 16.2 is fully inserted, second U-shaped member 18.9′ protrudes through window 16.9 in riser 16.4′ and free edge 18.12 abuts riser 16.4′. To store the antenna, the procedure is essentially reversed as described with reference to the embodiment of FIG. 1.

Universality is achieved in accordance with yet another embodiment of my invention depicted in FIGS. 4 and 5. A universal mount assembly 40 for mounting an antenna 42 on a motor vehicle trunk lid 44, regardless of vehicle make, comprises an elongated, relatively narow (e.g., 2' long by ½ inch wide) rectangular support member 46 adapted to be mounted under the lip 44.1 of lid 44 via fastener holes 46.1. Because all automobiles with a trunk have such a lip, support member 46 can be mounted thereon regardless of trunk contour. In contrast, the embodiment of FIGS. 1–2 are specially designed so that the support member is substantially congruent with the trunk contour.

As with the mount assemblies of FIGS. 1–2, however, the support member of this embodiment has a channel 46.2 adapted to receive lower tread 48.1 of stepped bracket 48. Channel 46.2 is formed, as before, by a pair of spaced, parallel guides 46.3 and a cover plate 46.4 which partially encloses the channel. A male member 50 is formed by a conical dimple or indentation in cover plate 46.4 and a recess 52 is formed in the bottom of lower tread 48.1. Groove 54 extends between recess 52 and a free edge of lower tread 48.1 so as to guide male member 50 into the recess when the lower tread is inserted into channel 46.2. Actually, groove 54 extends from recess 52 to optional notch 56 to be described hereinafter.

Along the front elongated edge 46.5 of support member 46, a U- or L-shaped member 58 is centrally located so as to form a slot 58.1 between its leg 58.2; its base 58.3 and the rectangular top surface of member 46. Slot 58.1 is adapted to receive the lip 44.1 of trunk lid 44. But, because such trunk lips vary in thickness from one make vehicle to another (e.g., between GM products and Chrysler products), another feature of this embodiment is the provision of a reversible, nonabrasive (e.g., Teflon) sleeve 60 which fits snuggly on leg 58.2 of U- or L-shaped member 58. As shown, the upper wall 60.1 is thinner than the lower wall 60.2 of sleeve 60 which enables lids of different thickness to be accommodated by simply choosing which of the two sleeve walls, 60.1 or 60.2, is placed in slot 58.1. Making sleeve 60 nonabrasive has the advantage that the painted finish of trunk lid 44 will not be scratched, as it might be if it were in direct contact with member 58 (typically made of steel).

As with the assembly of FIG. 2, this universal mount also has in riser 48.2 as rectangular window 48.3 which receives the base 58.3 of member 58 when lower tread 48.1 is fully inserted into channel 46.2.

However, another feature of the universal mount enables antenna 42 mounted on upper tread 48.4 to be vertically aligned regardless of trunk lip contour. Thus, support member 46 includes at least one of set screw 62 which is threaded into hole 46.8 located centrally near the rear elongated edge 46.6 of support member 46, e.g., in an appendage 46.7. Since screw 62 abuts the underside of lip 44.1, the depth that screw 62 is threaded into hole 46.8 determines trunk lip 44.1 and hence determines the antenna orientation. Because screw 62 is centrally located at the back of channel 46.2, the lower tread 48.1 is provided with notch 56 centrally located on its front edge so that when the lower tread is fully inserted, screw 62 fits into notch 56. Otherwise, screw 62 would prevent lower tread 48.1 from being fully inserted into channel 46.2.

Preferably, two additional set screws 64 are provided near opposite short edges (i.e., in the guides) of support member 46 so as to form a tripod which permits even more accurate vertical alignment of the antenna.

Briefly, the operation of the universal mount is as follows: assuming support member 46 and bracket 48 are fully assembled, the trunk is opened and support member 46 is locally mounted via fastener holes 46.1 on the underside of trunk lip 44.1. Sleeve 60 is oriented so that, when the set screws 62–64 are adjusted, lip 44.1 will fit snuggly in slot 58.1 of U- or L-shaped member 58. Next, set screws 62–64 are adjusted so that antenna 42 will be vertical when lower tread 48.1 is inserted into channel 46.2. This alignment may require repeated trial and error adjustments until the final desired antenna orientation is obtained. Finally, lower tread is inserted into channel 46.2 until, as before, male member 50 nsaps into recess 52. The trunk lid is now closed and the antenna is ready for normal operation.

Figure 3:
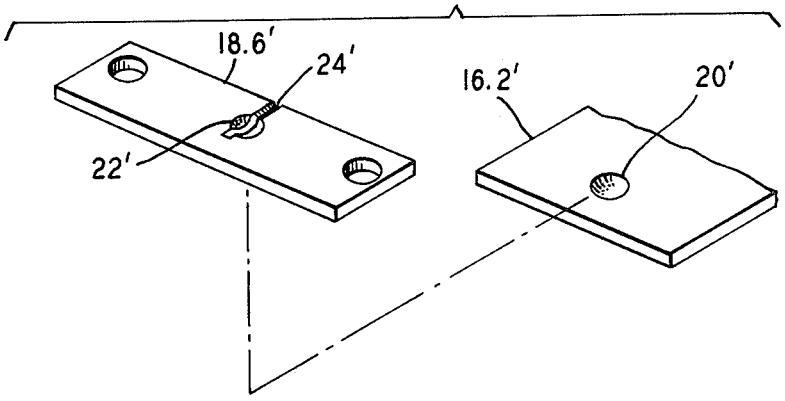
FIG. 3 is a partial pictorial showing the recess on the cover plate and the male member on the lower tread instead of conversely.

While the foregoing description contains many specifications, these should not be construed as limitations upon the scope of the invention, but merely as an indication of several preferred embodiments thereof; the true scope of the invention is indicated by the subject of the appended claims and their legal equivalents. In particular, while FIGS. 1, 2, 4, and 5 depict the recess and groove as being formed in lower tread and the male member in a cover plate, it is readily feasible, as shown in FIG. 3, to form recess 22' and groove 24' in cover plate 18.6' and male member 20' in lower tread 16.2'.

Moreover, although the channel in the foregoing embodiments is defined by a pair of spaced, parallel guides, and the trunk lip is engaged by a U-shaped member on the support member, other variations are possible without departing from the spirit and scope of the invention. For instance, the U-shaped member can be rotated 180° to define the channel instead of being used to engage the trunk lip. In this case, a pair of male members can be formed on a leg of the U with a matching pair of recess-grooves being on the lower tread of the bracket. Now, in order to allow engagement to the trunk lip, the riser is provided with a flat plate appendage which protrudes from the riser and is oriented in the same direction as, and essentially parallel to, the lower tread. When the lower tread is inserted in the channel, both male members snap into the matching recesses and the trunk lip is located snuggly in the space between the appendage and the upper leg of the U-shaped member. In this configuration, the support member is not visible when the bracket (i.e., the antenna thereon) is detached because the entire U-shaped member is positioned beneath the trunk lid.

What is claimed is:

1. A universal assembly for mounting an antenna on the lip of an automobile trunk lid comprising a stepped bracket including an upper tread on which said antenna is mounted, a lower tread having a recess therein and a groove extending from said recess to a free edge of said lower tread, and a riser connecting said treads together and having a window essentially centrally located therein, a relatively narrow elongated support member mountable along said trunk lip; said support member including a pair of spaced, parallel guides defining a channel therebetween into which said lower tread is insertable and having a width substantially equal to the width of said lower tread, a cover plate partially enclosing said channel and having a male member thereon which protrudes into said channel and which is guided by said groove into said recess when said lower tread is inserted into said channel, and an L-shaped member having a base affixed above the entrance to said channel and a leg extending above said channel so as to define a slot into which said trunk lip in insertable, said window in said riser being adapted to receive said base when said lower tread is fully inserted into said channel, a nonabrasive sleeve on said leg of said L-shaped member, and means for orienting said support member on said trunk lip so that said antenna can be vertically aligned.

2. The assembly of claim 1 wherein opposite upper and lower walls of said sleeve have different thicknesses and said sleeve is reversible so that different thickness trunk lips can be made to fit snuggly in said slot.

3. The assembly of claim 2 including means for at least loosely mounting said support member on said trunk lip, and wherein said orienting means comprises three set screws extending through said support member so as to form a tripod, said screws contacting said body so that the depth to which each of said screws is threaded is effective both to change the orientation of said support member, and hence said antenna, with respect to said trunk lip and to tightly secure said support member to said lip.

4. An assembly for mounting an object on a rigid body comprising a bracket for carrying said object, and a support member mounted on said body and having a channel therein for receiving a portion of said bracket, CHARACTERIZED BY securing means for releaseably locking said bracket portion to said support member including male and female members located on separate ones of said bracket portion and said support member adapted to engage one another when said bracket portion is inserted into said channel, said male member extends transverse to the direction of insertion of said bracket portion into said channels, said support member includes a pair of shaped guides defining said channel therebetween, a first U-shaped member connected obliquely to said guides so as to define an entrance port in communication with said channel, and means partially enclosing said channel, said bracket portion being insertable through said entrance port into said channel.

5. The assembly of claim 4 wherein said enclosing means comprises at least one cover plate affixed to said guides, and one of said male or female members is located on said at least one cover plate.

6. The assembly of claim 4 wherein said support member further includes a second U-shaped member connected transversely to said first U-shaped member and having a slot which engages an edge of said body, and fastener means for securing said edge in said slot.

7. The assembly of claim 6 wherein said guides and U-shaped members are configured to be substantially congruent to a cross-section of said body so as to fit substantially flush thereon.

8. The assembly of claim 6 wherein said bracket has a stepped configuration and includes an upper tread on which said object is mounted, a lower tread which includes said portion insertable into said channel, and a riser connecting said treads together, and one of said male or female members is located on said lower tread and the other is located on said at least one cover plate.

9. The assembly of claim 8 wherein the one of said lower tread or cover plate on which said female member is located has a recess defining said female member and groove extending from said recess to the edge of said one lower tread or cover plate so as to guide said male member into said recess and releaseably lock said bracket to said support member.

10. An assembly for mounting an object on a rigid body comprising a bracket for carrying said object, and a support member mounted on said body and having a channel therein for receiving a portion of said bracket, CHARACTERIZED BY, securing means for releaseably locking said bracket portion to said support member including male and female members located on separate ones of said bracket portion and said support member adpated to engage one another when said bracket portion is inserted into said channel, said male member extends transverse to the direction of insertion of said bracket portion into said channel, said support member includes a pair of spaced guides defining said channel therebetween , a cover plate partially enclosing said channel and an L-shaped member located above the entrance to said channel so as to form a slot for engaging an edge of said body, said bracket has a stepped configuration and includes an upper tread on which said object is mounted, a lower tread which includes said portion insertable into said channel, and a riser connecting said treads together and having a window therein adapted to receive the base of said L-shaped member when said lower tread is fully inserted in said channel, and one of said maile or female members is located on said lower tread and the other is located on said cover plate.

11. The assembly of claim 10 including a nonabrasive sleeve on the leg of said L-shaped member effective to protect said body edge from damage by scratching and the like.

12. The assembly of claim 11 wherein opposite upper and lower walls of said sleeve have different thicknesses and said sleeve is reversible so that different thickness body edges can be made to fit snuggly in said slot.

13. The assembly of claim 10 including means for orienting said support member on said body so that said object can be vertically aligned.

14. The assembly of claim 13 including means for at least loosely mounting said support member on said body, and wherein said orienting means comprises a plurality of screw means extending through said support member and contacting said body, the depths to which said screw members are threaded being effective to adjust the orientation of said support member with respect to said body and to tightly secure said support member to said body.

15. The assembly of claim 14 wherein said plurality of screw means includes three set screws located along three different edges of said support member so as to form a tripod.

16. An assembly for mounting an antenna on a rigid body, such as an automobile trunk lid or the like, comprising a stepped bracket including an upper tread for carrying said antenna, a lower tread having a recess therein and a groove extending from said recess to a free edge of said lower tread, and a riser connecting said treads together, a support member mounted on said body and including a pair of parallel guides defining a channel into which said lower tread is insertable, and a first U-shaped member connected obliquely to said guides so as to define an entrance port in communication with said channel, means partially enclosing said channel including at least one cover plate connected to said guides and having thereon a male member which protrudes into said channel and is guided by said groove into said recess when said lower tread is inserted through said entrance port into said channel, a second U-shaped member connected transversely to said first U-shaped member and defining a slot which engages an edge of said body, and fastener means extending through said second U-shaped member for securing said body edge in said slot, said guides and U-shaped members being configured to be substantially congruent with a cross-section of said body so as to fit substantially flush thereon.

17. The assembly of claim 16 wherein said second U-shape member has a base and two legs formed by folding a portion of said first U-shaped member upon itself to define said slot between said legs, said support member having a substantially rectangular window located centrally in said riser and adpated so that said base fits flush therein when said lower tread is fully inserted into said channel.

18. The assembly of claim 16 wherein said second U-shaped member is an appendage located centrally on a free edge of said first U-shaped member and said riser has a window therein adpated to receive said second U-shaped member when said lower tread is fully inserted into said channel so that said riser is flush with said free edge.

19. An assembly for mounting an antenna on a rigid body, such as an automobile trunk lid or the like, comprising a stepped bracket including an upper tread for carrying said antenna, a lower tread having a male member protruding therefrom, and a riser connecting said treads together, a support member mounted on said body and including a pair of parallel guides defining a channel into which said lower tread is insertable, and a first U-shaped member connected obliquely to said guides so as to define an entrance port in communication with said channel, means partially enclosing said channel including at least one cover plate connected to said guides, and having a recess therein and a groove extending from said recess to a free edge of said plate so that said male member is guided into said recess when said lower tread is inserted through said entrance port into said channel, a second U-shaped member connected transversely to said first U-shaped member and defining a slot which engages an edge of said body, and fastener means extending through said second U-shaped member for securing said body edge in said slot, said guides and U-shaped members being configured to be substantially congruent with a cross-section of said body so as to fit substantially flush thereon.

20. The assembly of claim 19 wherein said second U-shaped member has a base and two legs formed by folding a portion of said first U-shaped member upon itself to define said slot between said legs, said second U-shaped member having a substantially rectangular window located centrally in said base and adapted so that said riser fits flush therein when said lower tread is fully inserted into said channel.

21. The assembly of claim 19 wherein said second U-shaped member is an appendage located centrally on a free edge of said first U-shaped member and said riser has a window therein adapted to receive said second U-shaped member when said lower tread is fully inserted into said channel so that said riser is flush with said free edge.

* * * * *